US006912954B2

(12) United States Patent
Tomita

(10) Patent No.: US 6,912,954 B2
(45) Date of Patent: Jul. 5, 2005

(54) ADJUSTING METHOD AND APPARATUS OF INK FOUNTAIN BLADE HOME POSITION OF PRINTING PRESS

(75) Inventor: Toshikazu Tomita, Toride (JP)

(73) Assignee: Komori Corporation, Tokyo (JP)

( * ) Notice: Subject to any disclaimer, the term of this patent is extended or adjusted under 35 U.S.C. 154(b) by 113 days.

(21) Appl. No.: 10/041,498

(22) Filed: Jan. 10, 2002

(65) Prior Publication Data

US 2002/0056385 A1 May 16, 2002

(30) Foreign Application Priority Data

Jan. 18, 2001 (JP) ..... 2001-009679

(51) Int. Cl.[7] ..... B41F 31/02
(52) U.S. Cl. ..... 101/365; 101/485
(58) Field of Search ..... 101/207, 365, 101/485, 208, 335, 483, 486, DIG. 47

(56) References Cited

U.S. PATENT DOCUMENTS

| | | | | | |
|---|---|---|---|---|---|
| 3,134,325 | A | * | 5/1964 | Worthington et al. | 101/365 |
| 3,702,587 | A | * | 11/1972 | Lee | 101/207 |
| 3,792,659 | A | * | 2/1974 | Albrecht | 101/365 |
| 3,930,447 | A | * | 1/1976 | Murray | 101/365 |
| 4,008,664 | A | * | 2/1977 | Crum et al. | 101/365 |
| 4,193,345 | A | * | 3/1980 | Schoneberger et al. | 101/365 |
| 4,581,994 | A | * | 4/1986 | Wildmann | 101/363 |
| 4,703,691 | A | * | 11/1987 | Takeuchi et al. | 101/365 |
| 4,969,395 | A | | 11/1990 | Mitamura et al. | |
| 5,138,944 | A | | 8/1992 | Rancourt et al. | |
| 5,832,830 | A | * | 11/1998 | Rancourt et al. | 101/365 |

FOREIGN PATENT DOCUMENTS

| | | |
|---|---|---|
| DE | 195 35 193 A1 | 3/1997 |
| GB | 2 296 894 A | 7/1996 |
| JP | 63168359 A | 12/1988 |

* cited by examiner

*Primary Examiner*—Andrew H. Hirshfeld
*Assistant Examiner*—Leo T. Hinze
(74) *Attorney, Agent, or Firm*—Birch, Stewart, Kolasch & Birch, LLP

(57) ABSTRACT

A method and apparatus are disclosed for numerically adjusting the home position of a plurality of ink fountain blades in a printing press. In the printing press, apparatus is provided for adjusting the ink feed amount to be supplied from an ink fountain into an ink fountain roller by adjusting the position of these ink fountain blades, supplying ink to a printing plate through the ink fountain roller, and printing the ink supplied on the printing plate on a printing sheet. The present method and apparatus first position each ink fountain blade at its home position, then set the indication of the position of each ink fountain blade at a predetermined value. Each ink fountain blade is then adjusted by the same amount while observing the indication of the position of each ink fountain blade. Finally, the position of each ink fountain blade as so adjusted is stored as a new home position.

11 Claims, 10 Drawing Sheets

(a)

(b)

ADJUSTING METHOD AND APPARATUS OF INK FOUNTAIN BLADE HOME POSITION OF PRINTING PRESS

This nonprovisional application claims priority under 35 U.S.C. § 119(a) on Patent Application No. 2001-009679 filed in Japan on Jan. 18, 2001, which is herein incorporated by reference.

The entire disclosure of Japanese Patent Application No. 2001-009679 filed on Jan. 18th, 2001 including specification, claims, drawings and summary is incorporated herein by reference in its entirety.

BACKGROUND OF THE INVENTION

1. Field of the Invention

The present invention relates to an adjusting method and apparatus for the home position of ink fountain blades of a printing press.

2. Description of the Related Art

In an ink supply source of an inking device of a printing press, a plurality of ink fountain blades having a specific width are arranged against an ink fountain roller along the roller's axial direction. These ink fountain blades have a mechanism for adjusting the inking amount at an opening degree suited to the printing pattern amount.

Usually, the ink fountain blades are adjusted at the time of machine maintenance by an operator manually turning the ink adjusting screws of the individual ink fountain blades on the basis of the zero point (home position) of the position of forming an ink film of a specified micron unit smoothly on the ink fountain roller.

However, the thus adjusted zero point position actually drifts, due to thermal expansion by temperature changes, because the parts of the ink supply source are made of metal materials. Also the ink material used in printing varies in its flow characteristics due to temperature or kneading condition, and the ink film amount at the zero point position is varied.

Therefore, in daily operations, the ink film amount at the zero point position on the ink fountain roller changes to be slightly insufficient or excessive along the width direction of the ink fountain roller depending on condition changes at any given moment.

SUMMARY OF THE INVENTION

Hitherto, in spite of such changes, printing was believed to depend on the operator's skill to match the printing colors while adjusting the opening degree of the ink fountain blades during operation, and the numerical value of the opening degree was regarded only as a guideline. Therefore, deviation of the zero point position was not considered to be a serious problem. In addition, because the adjustment is very troublesome and difficult, it is not adjusted normally until an operation limit is reached or a printing failure has occurred.

Recently, owing to the development of digital printing technology and the requirement for shorter printing time, the importance of numerical control has been recognized and accuracy is demanded, and it is becoming more important to maintain the zero point accurately.

For example, a technology for correction of the zero point position by manual adjustment of the ink adjusting screws of ink fountain blades was proposed in Japanese Patent Publication No. 7-96293.

In this method, however, multiple ink fountain blades are adjusted in a manual and analog fashion. An advanced level of skill is required, and hence the adjustment takes considerable time and labor in adjustment work.

Changes due to the type of ink or the environment are almost same in the ink film amount in all ink fountain blades, but the ink adjusting screws of all ink fountain rollers must be individually adjusted manually, and it takes considerable time in adjustment and is difficult for the operator.

It is hence a first object of the invention to provide a method and apparatus for adjustment of the home position of ink fountain blades of a printing press capable of handling the position of ink fountain blades numerically, and decreasing the operator's labor and working time.

It is a second object of the invention to present a method and apparatus for adjustment of the home position of ink fountain blades of a printing press capable of increasing or decreasing all ink fountain rollers by a single operation, thereby greatly decreasing the operator's labor and working time.

To achieve these objects, the ink fountain blade home position adjusting method of printing press of the present invention is an ink fountain blade home position adjusting method for printing presses having a plurality of ink fountain blades, for adjusting the ink feed amount to be supplied from an ink fountain into an ink fountain roller by adjusting the position of these ink fountain blades, supplying ink to a printing plate through the ink fountain roller, and printing the ink supplied on the printing plate on a printing sheet, comprising a first step of positioning each ink fountain blade at a home position, a second step of setting the indication of the position of each ink fountain blade at a predetermined value, a third step of adjusting the position of each ink fountain blade while observing the indication of the position of each ink fountain blade, and a fourth step of storing the position of each ink fountain blade adjusted at the third step as a new home position.

The printing press has a drive device for adjusting the position of each ink fountain blade, and a control device for controlling the drive device, and, at the third step, the position of each ink fountain blade is adjusted by a switch provided in the control device.

The present invention also presents an ink fountain blade home position adjusting method for a printing press having a plurality of ink fountain blades, for adjusting the ink feed amount to be supplied from an ink fountain into an ink fountain roller by adjusting the position of these ink fountain blades, supplying ink to a printing plate through the ink fountain roller, and printing the ink supplied on the printing plate on a printing sheet, comprising a first step of positioning each ink fountain blade at a home position, a second step of adjusting the position of all ink fountain blades by the same amount by a switch operation, and a third step of storing the position of each ink fountain blade as adjusted at the second step as a new home position.

The method further comprises a fourth step of setting the indication of the position of each ink fountain blade at a predetermined value after the first step, in which the position of each ink fountain blade is adjusted while observing the indication of the position of each ink fountain blade at the second step.

The ink fountain blade home position adjusting apparatus for a printing press of the present invention is an ink fountain blade home position adjusting apparatus of printing press having plural ink fountain blades, for adjusting the ink feed amount to be supplied from an ink fountain into an ink fountain roller by adjusting the position of these ink fountain blades, supplying ink to a printing plate through the ink fountain roller, and printing the ink supplied on the printing plate on a printing sheet, comprising a drive device for adjusting the position of each ink fountain blade, and a control device for controlling the drive device, positioning each ink fountain blade at a home position, setting its indication at a predetermined value, and storing the adjusted position of each ink fountain blade as a new home position while observing the indication.

In addition, an indicator for indicating the position of each ink fountain blade and a switch for adjusting the position of each ink fountain blade are further provided near the plurality of ink fountain blades.

In addition, the drive device comprises a stepping motor assembled in the ink fountain main body so as to correspond to each ink fountain blade, and a screw shaft connected to an output shaft of the stepping motor through a gear train, and having a first threaded portion coupled to a fixing member fixed on the ink fountain main body and a second threaded portion coupled to each ink fountain blade, and rotation of the screw shaft by said stepping motor causes movement of the screw shaft itself, and differential movement of the ink fountain blade coupled to the second threaded portion of said screw shaft causes movement of the ink fountain blade in directions so as to contact with and depart from the ink fountain roller.

In addition, a pressure spring is held by a support shaft projecting from said ink fountain main body and a support shaft attached to the ink fountain blade, and the ink fountain blade is always pressed against the opposite side of the ink fountain roller by this pressure spring, so that any excessive play in each screw coupling portion is reduced.

The invention moreover presents an ink fountain blade home position adjusting apparatus for a printing press having a plurality of ink fountain blades, for adjusting the ink feed amount to be supplied from an ink fountain into an ink fountain roller by adjusting the position of these ink fountain blades, supplying ink to a printing plate through the ink fountain roller, and printing the ink supplied on the printing plate on a printing sheet, comprising a drive device for adjusting the position of each ink fountain blade, and a control device for controlling the drive device, positioning each ink fountain blade at a home position, adjusting the position of all ink fountain blades by the same amount by a switch operation, and storing the adjusted position of each ink fountain blade as a new home position.

The control device sets the indication of the position of each ink fountain blade at a predetermined value prior to adjustment of the home position after positioning each ink fountain blade at its home position.

Further, an indicator for indicating the position of each ink fountain blade and the switch are provided near the plurality of ink fountain blades.

In addition, the drive device comprises a stepping motor assembled in the ink fountain main body so as to correspond to each ink fountain blade, and a screw shaft connected to an output shaft of the stepping motor through a gear train, and having a first threaded portion coupled to a fixing member fixed on the ink fountain main body and a second threaded portion coupled to each ink fountain blade, rotation of the screw shaft by said stepping motor causes movement of the screw shaft itself and differential movement of the ink fountain blade coupled to the second threaded portion of said screw shaft, causes movement of the ink fountain blade in directions so as to contact with and depart from the ink fountain roller.

Further, a pressure spring is held by a support shaft projecting from said ink fountain main body and a support shaft attached to the ink fountain blade, such that the ink fountain blade is always pressed against the opposite side of the ink fountain roller by this pressure spring, so that any excessive play in each screw coupling portion is reduced.

DESCRIPTION OF THE PREFERRED EMBODIMENT

Figure 1:
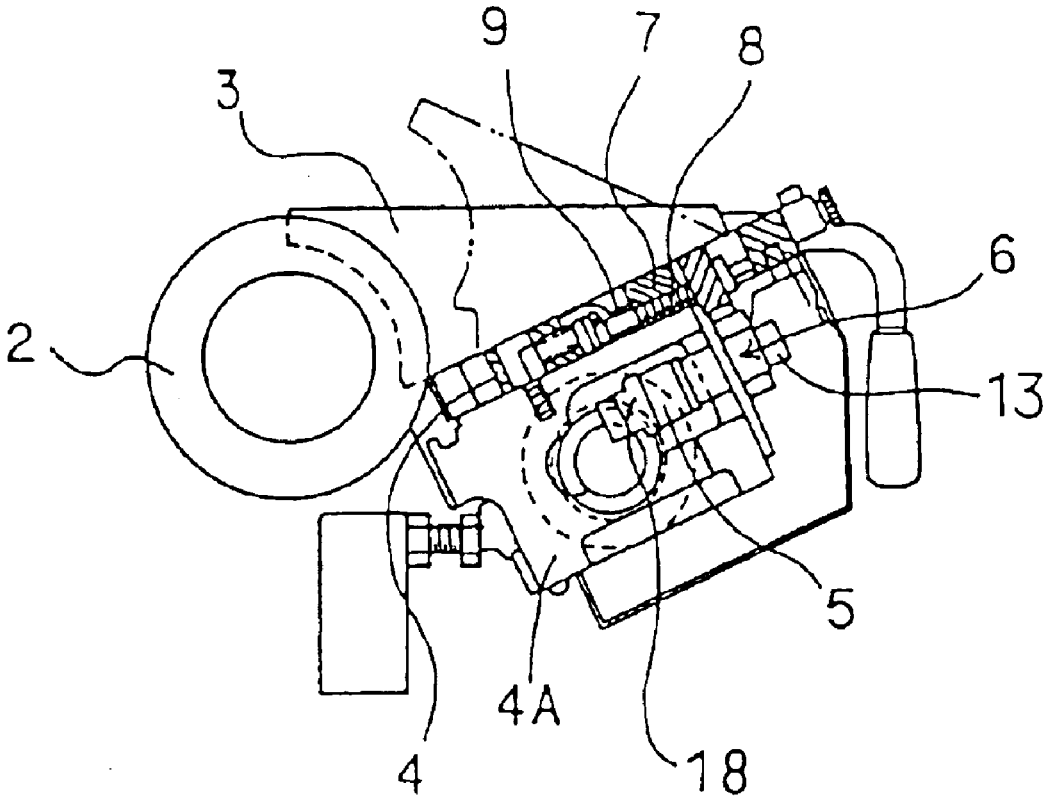
FIG. 1 is a side sectional view of an ink fountain device showing a first embodiment of the invention.

Referring now to the drawings, embodiments of the method and apparatus for adjustment of the home position of ink fountain blades of printing presses of the present invention are described in detail below.

First Embodiment

Figure 2:
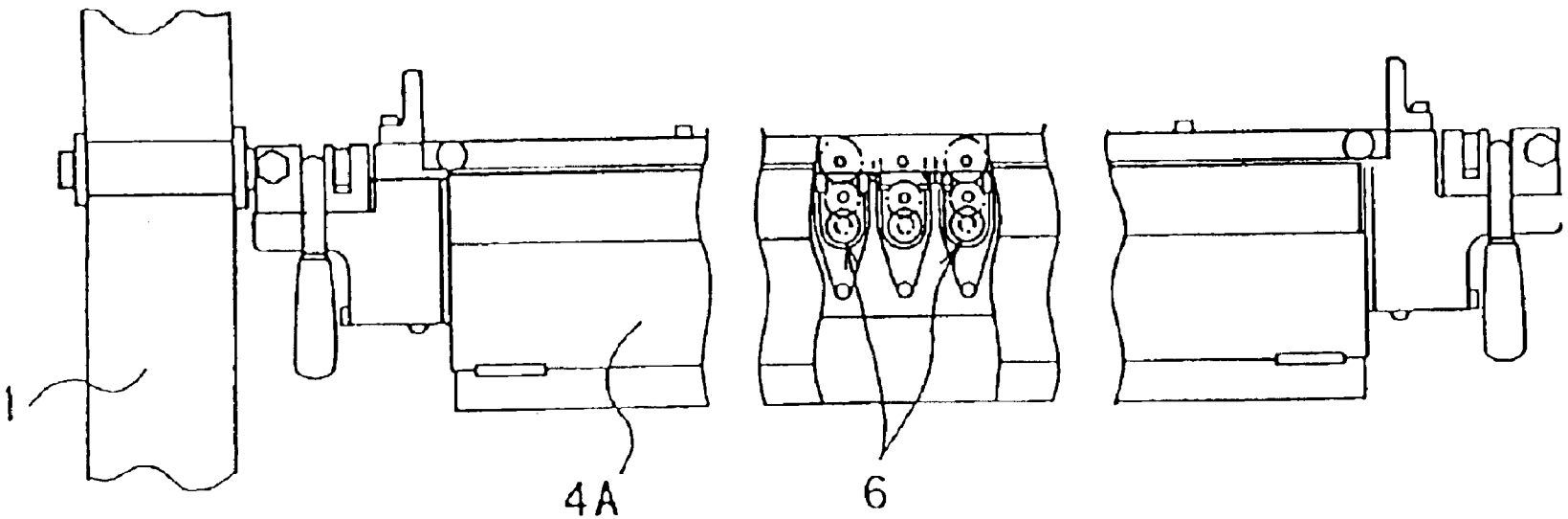
FIG. 2 is a rear view of the same.
Figure 3:
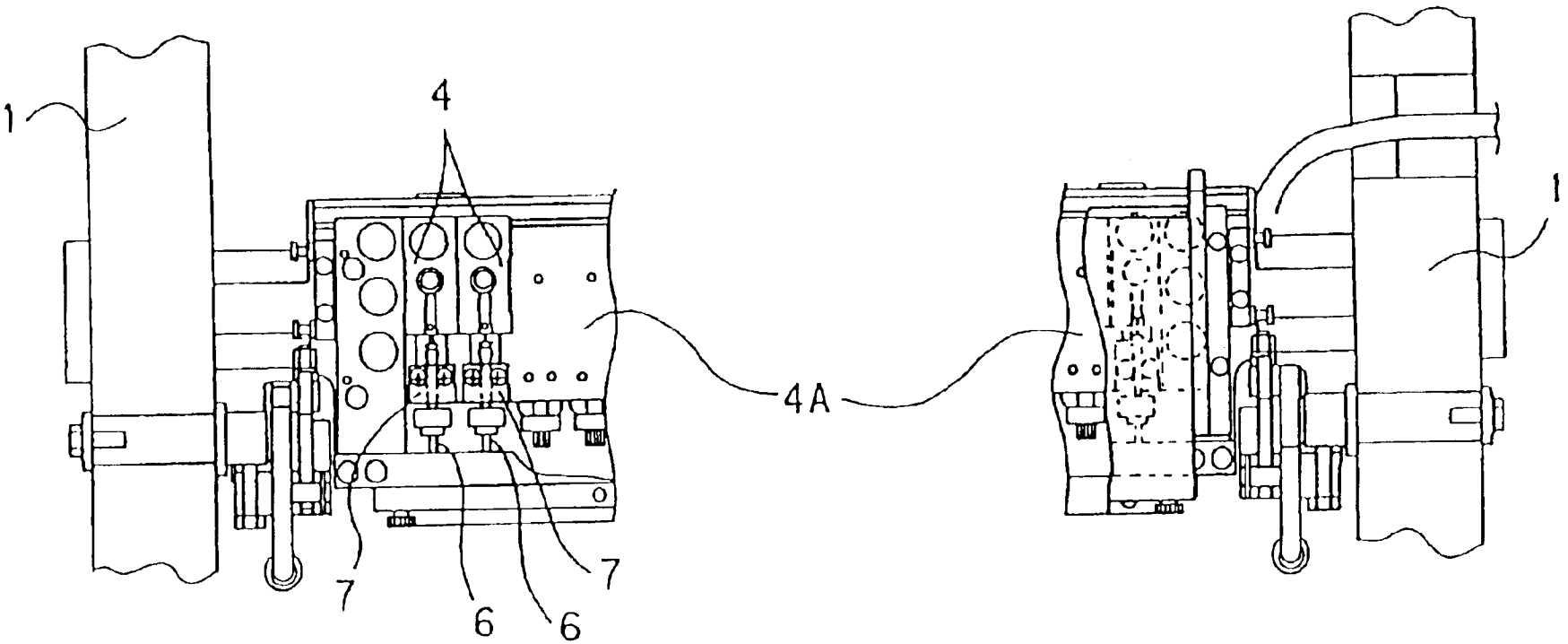
FIG. 3 is a plan view of the same.
Figure 4:
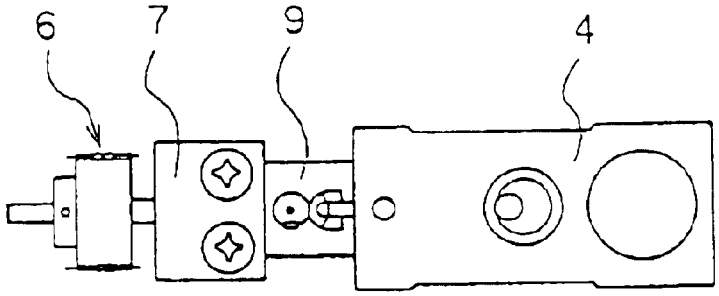
FIG. 4 is structural drawing of an ink fountain blade, in which (a) is a plan view and (b) is a side sectional view.
Figure 4:
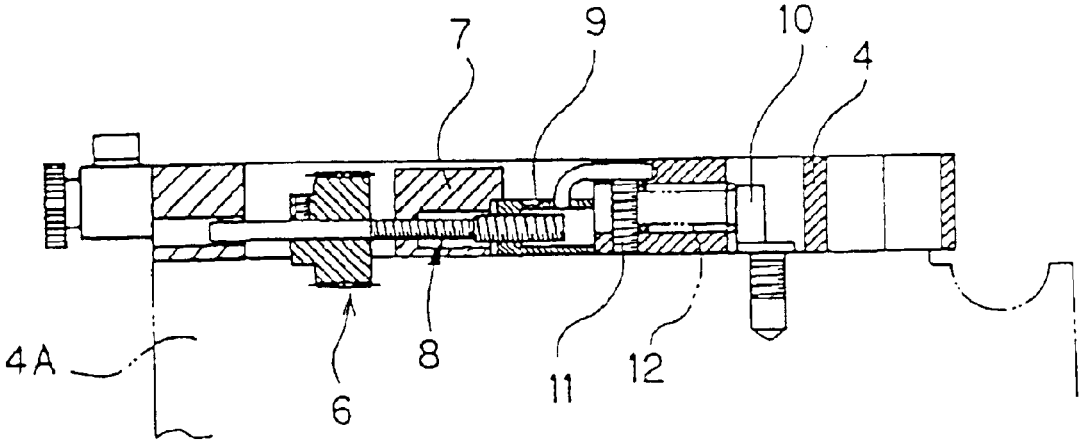
Figure 5:
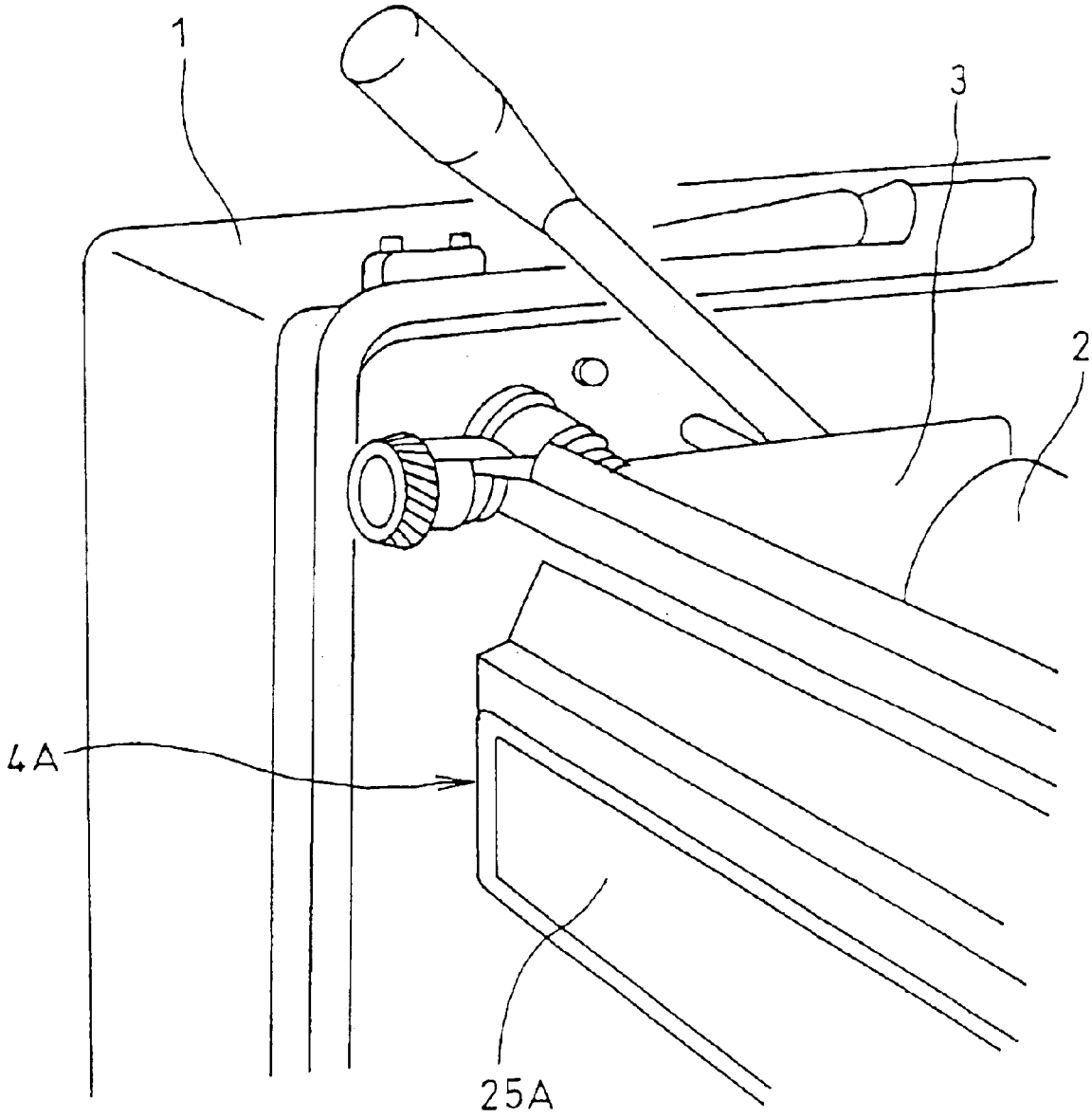
FIG. 5 is an essentially perspective view of the ink fountain device.
Figure 6:
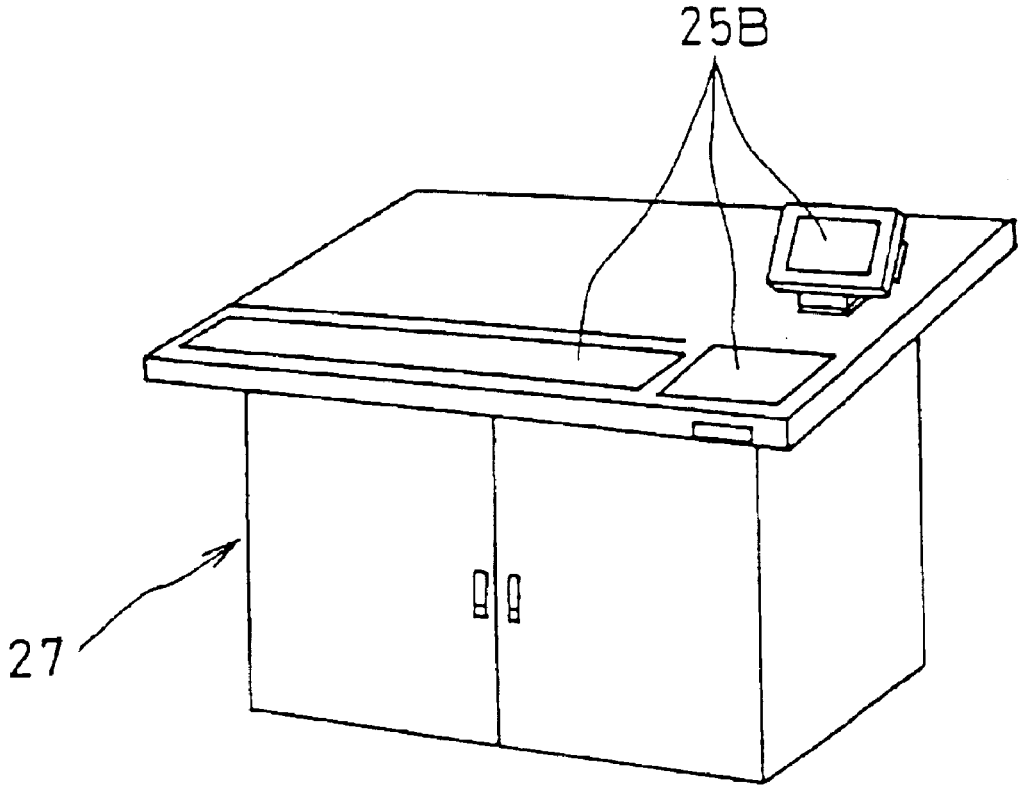
FIG. 6 is a perspective view of an operation stand.
Figure 7:
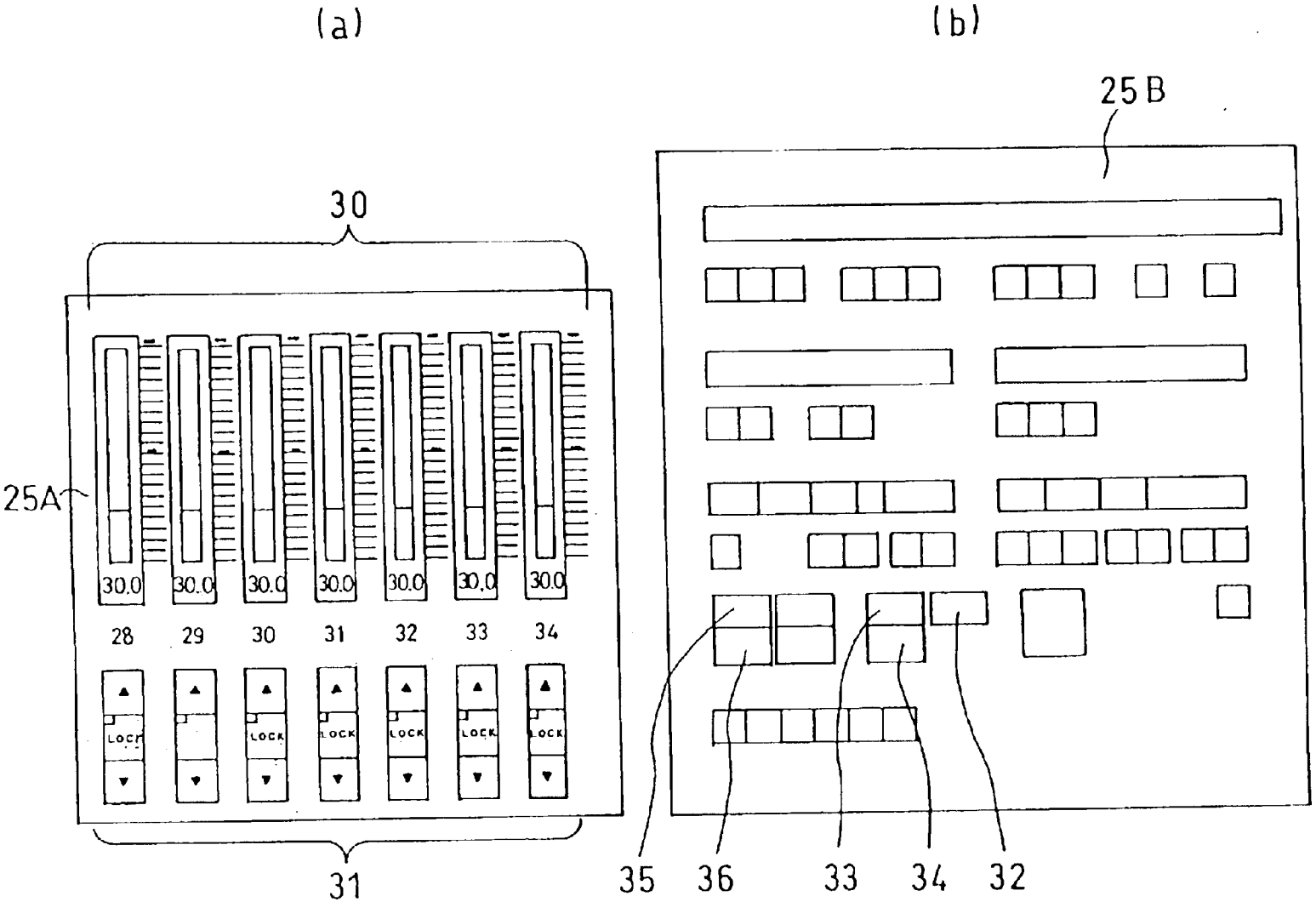
FIG. 7 is an explanatory diagram of the operation and display unit, in which (a) is an explanatory diagram of the operation and display unit provided in each ink fountain device and (b) is an explanatory diagram of the operation and display unit provided in the operation stand.
Figure 8:
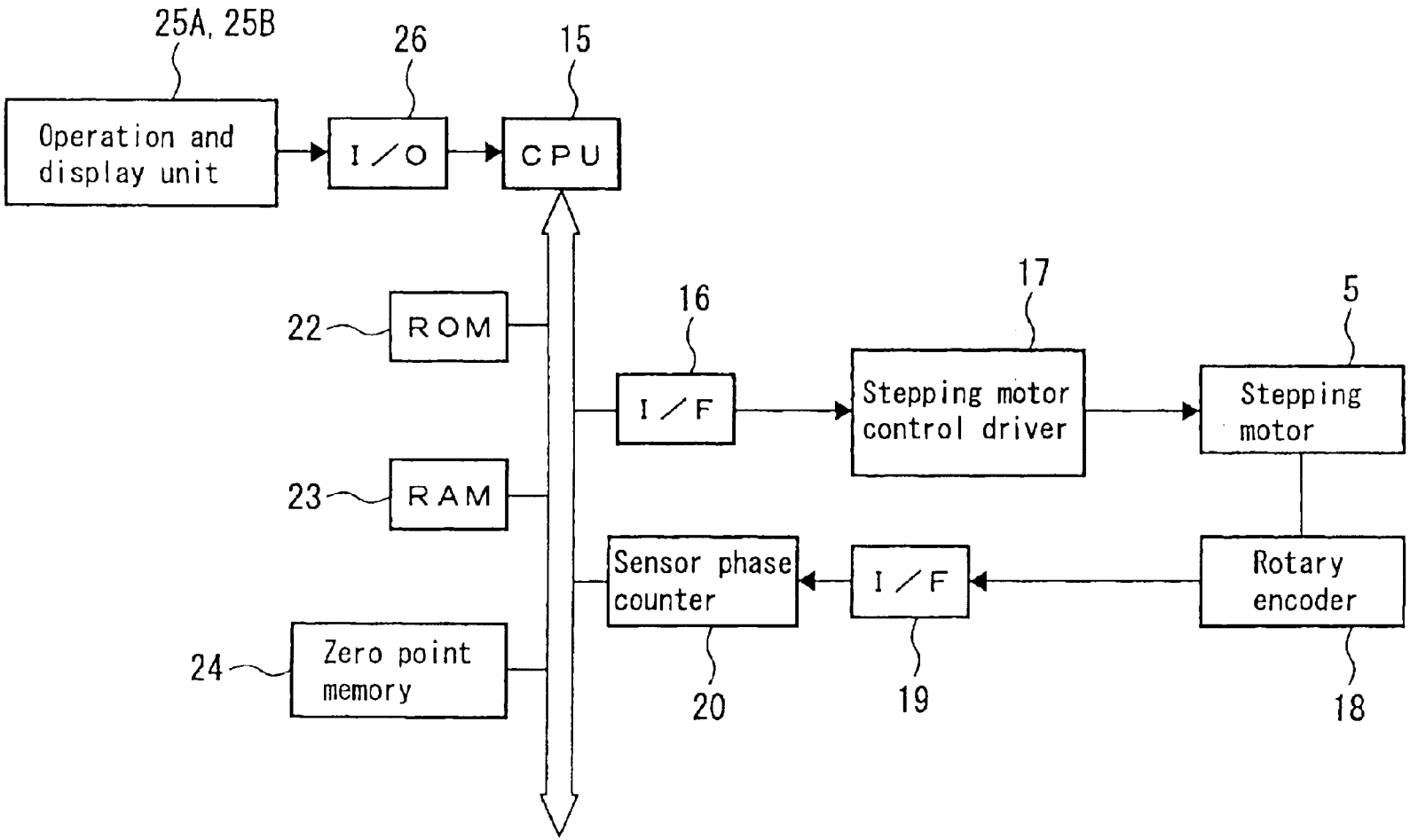
FIG. 8 is a control block diagram of the same.
Figure 9:
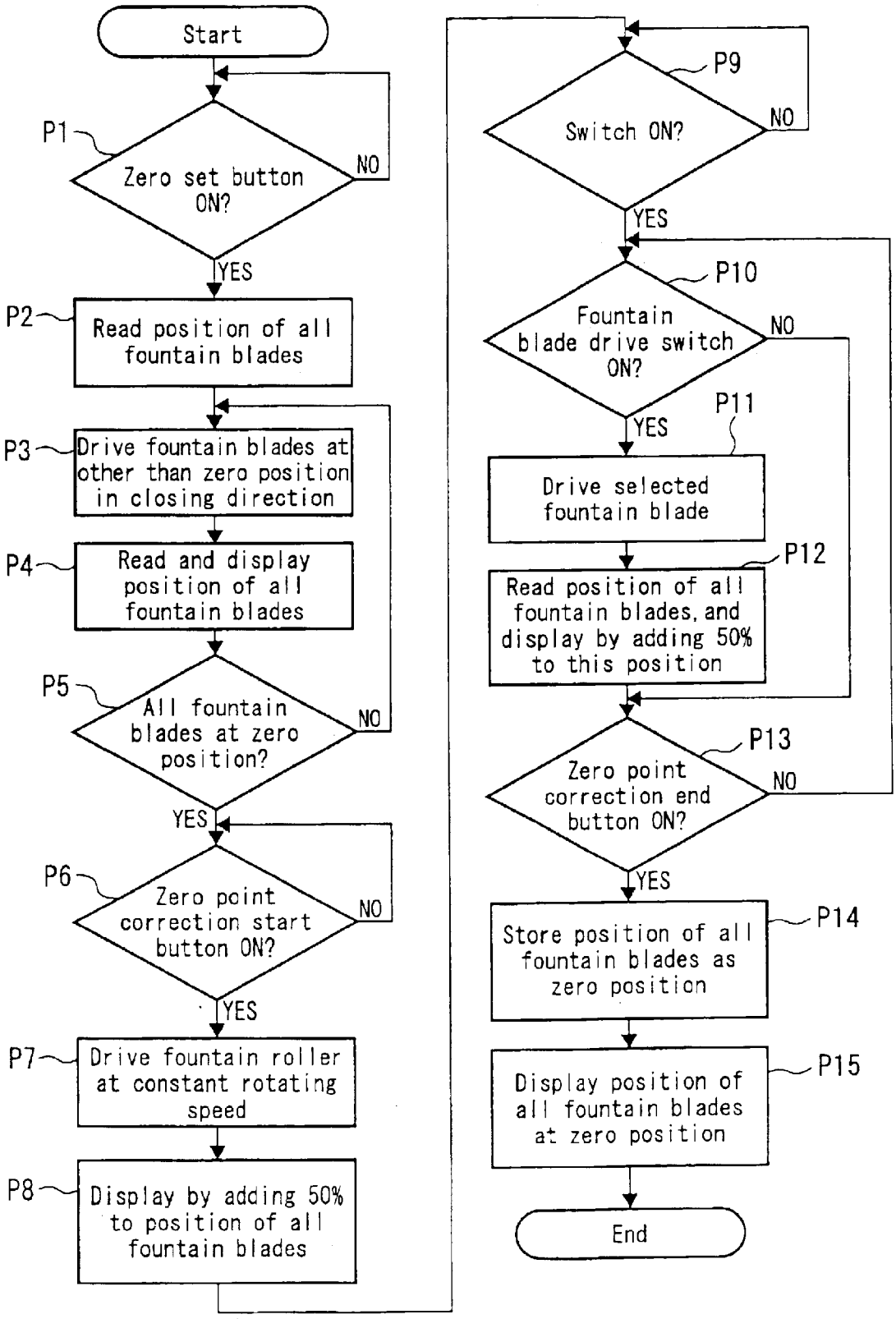
FIG. 9 is a flowchart in zero point correction of the same.

FIG. 1 is a side sectional view of an ink fountain device showing a first embodiment of the invention, FIG. 2 is a rear view of the same, FIG. 3 is a plan view of the same, FIG. 4 is structural drawing of ink fountain key, in which (a) is a plan view and (b) is a side sectional view, FIG. 5 is an essentially perspective view of the ink fountain device, FIG. 6 is a perspective view of operation stand, FIG. 7 is an explanatory diagram of operation and display unit, in which (a) is an explanatory diagram of the operation and display unit provided in each ink fountain device and (b) is an explanatory diagram of the operation and display unit provided in the operation stand, FIG. 8 is a control block diagram of the same, and FIG. 9 is a flowchart in zero point correction of the same.

As is shown in FIG. 1 to FIG. 3, the ink fountain device of a printing press comprises an ink fountain roller 2 supported on right and left frames 1 to rotate. Weirs 3 are provided on the periphery and at both ends of the ink fountain roller 2. An ink fountain having a triangular section formed of a plurality of ink fountain blades 4 is arranged parallel to the longitudinal direction of the ink fountain roller 2.

By an adjustment of the opening degree of each ink fountain blade 4 against the periphery of the ink fountain roller 2, the ink feed amount to be supplied from the ink fountain into the ink fountain roller 2 is adjusted, and the ink is supplied onto the printing plate through the ink fountain roller 2. The ink supplied onto the printing plate is then printed on a sheet.

That is, each ink fountain blade 4 is designed to move (slide) individually in a direction which permits the ink fountain blade to either be contacting with or departing from the ink fountain roller 2 by means of ink fountain blade drive device and manual position adjusting device which are described below.

The ink fountain blade drive device is mainly composed of, as shown in FIG. 4, a stepping motor 5 (see FIG. 1) which is assembled in the ink fountain main body 4A, is associated with each ink fountain blade 4. A screw shaft 8 is coupled to a fixing member 7, which is affixed on the ink fountain main body 4A and is linked to the output shaft of the stepping motor 5 through a gear train 6. An intermediate member 9, coupled to the ink fountain blade 4, is connected to the widened threaded portion at the leading end of the screw shaft 8.

Therefore, as the screw shaft 8 coupled to the fixing member 7 is rotated by the stepping motor 5, the ink fountain blade 4 is pressed in a direction to be contacting with or departing from the ink fountain roller 2 (see FIG. 1) by means of the movement of the screw shaft 8 itself and the differential movement of the intermediate member 9 coupled to the leading end of the screw shaft 8.

Further, a pressure spring 12 is held by a support shaft 10 projecting from the ink fountain main body 4A. A support shaft 11 is incorporated in the rear part of the ink fountain blade 4. The ink fountain blade 4 is pushed by this pressure spring 12 so as to be always of in a direction away from the ink fountain roller 2, so that any excessive play in the screw coupling parts is reduced.

The manual position adjusting device comprises, as shown in FIG. 1, a rotation knob 13 fixed to the output shaft of the stepping motor 5. The rotational force of the rotation knob 13 is transmitted to the screw shaft 8 through the gear train 6.

The stepping motor 5 is driven and controlled by a CPU 15 as a control device (main controller) using a microprocessor and other components as is shown in FIG. 8. Its control signal is entered by way of an interface 16 and a stepping motor control driver 17.

On the other hand, a detection signal (a signal indicative of the position of the ink fountain blade 4) is delivered from a rotary encoder 18 (see FIG. 1) attached to the stepping motor 5. The detection signal is entered in the CPU 15 by way of an interface 19 and a sensor phase counter 20.

The CPU 15 includes, aside from a fixed memory 22 and a variable memory 23, a zero point memory 24 of the ink fountain blade 4 in its periphery. The CPU 15 is connected with a bus together with the interface 16 and sensor phase counter 20.

Further, the CPU 15, as shown in FIG. 5 and FIG. 6, sends and receives specified signals through an input/output device 26 to and from operation and display units 25A, 25B which are provided on the front side of the ink fountain main body 4A of each ink fountain device and on an operation stand 27.

The operation and display unit 25A on the front side of the ink fountain main body 4A of each ink fountain device includes, as shown in FIG. 7(*a*), a group of indicators 30 showing the position of each ink fountain blade 4 of the ink fountain device, and a group of switches (up/down switches) 31 driving each ink fountain blade 4.

The operation and display unit 25B on the operation stand 27 includes in its part, as shown in FIG. 7(*b*), a zero set button (switch) 32 for positioning all ink fountain blades 4 at a zero position, a zero point correction start button (switch) 33, a zero point correction end button (switch) 34, an all-increase button (switch) 35 for opening all ink fountain blades 4 at once, and an all-decrease button (switch) 36 for closing all ink fountain blades 4 at once, together with other indicators and buttons (switches).

In this configuration, the home position adjustment operation of the ink fountain blades 4 by the CPU 15 is explained in detail by referring to the flowchart in FIG. 9.

First, at step P1, it is judged if the zero set button 32 on the operation stand 27 is turned on or not. If it is turned on, at step P2, the positions of all ink fountain blades 4 are read in by a detection signal from the rotary encoder 18 of the stepping motor 5.

At step P3, all of the ink fountain blades 4 which are other than at the zero position, are driven in the closing direction through the stepping motor 5. The positions of all ink fountain blades 4 are read in again at step P4, and the positions are shown in the indicator 30 on the front side of the ink fountain main body 4A.

At step P5, judging if all ink fountain blades 4 are at their zero positions or not, and, if at their zero positions, going to step P6, it is judged if the zero point correction start button 33 on the operation stand 27 is turned on or not. If not at their zero positions, on the other hand, returning to step P3, the ink fountain blades 4 which are at other than their zero positions are then driven in the closing direction.

If the zero point correction start button 33 has been turned on at step P6, the ink fountain roller 2 is driven at a constant rotating speed at step P7, and 50%, for example, is added to the positions of all ink fountain blades 4 at step P8 and is displayed. That is, while the positions of the ink fountain blades 4 are remaining presently at the zero position, only the control display of the indicator 30 on the front side of the ink fountain main body 4A is changed to an intermediate display (for example, an indication of 50 in the display region of 0 to 100).

Afterwards, at step P9, judging if any switch is turned on, and if turned on, at step P10, it is judged if the switch (up/down switch) 31 for driving the ink fountain blades 4 on the front side of the ink fountain main body 4A is turned on or not.

If the switch 31 has been turned on at step P10, the selected ink fountain blade 4 is driven by the stepping motor 5 at step P11. This switch is manipulated while observing the opening degree of the ink fountain blade 4 on the indicator 30.

At step P12, the positions of all ink fountain blades 4 are read in, and the position adding 50% to the read-in position is shown by the indicator 30. It is then judged at step P13 if the zero point correction end button 34 on the operation stand 27 is turned on or not. On the other hand, if the switch 31 has not been turned on at step P10, it is judged if the zero point correction end button 34 is turned on or not at this step P13.

When the zero point correction end button 34 has been turned on at step P13, the positions of all ink fountain blades 4 are stored as zero positions at step P14. The positions of all ink fountain blades 4 are indicated as zero positions at step P15, and the home position adjustment operation is terminated. If the zero point correction end button 34 has not been turned on at step P13, returning to step P10, it is judged if the switch 31 is turned on or not. That is, the zero point correction operation is continued repeatedly.

Thus, in this embodiment, in adjustment of home position, since the position of each ink fountain blade can be handled numerically by the numerical value of opening degree or bar indication displayed in the indicator 30 on the front side of the ink fountain main body 4A, the operation is clear and easy to understand. Also because of switch (button) operation, it is easier to accomplish as compared with the individual adjustment of the ink adjusting screws in the separate ink fountain blades as in the prior art. It is also excellent in durability because overload does not occur on the screw mechanism of the ink fountain blade drive device.

Also in this embodiment, comprising the all-increase button 35 and all-decrease button 36, if the ink film amounts of all ink fountain blades 4 are changed by nearly the same amount by the change in the type of ink or environments, it can be adjusted by a single operation of the all-increase button 35 or all-decrease button 36, instead of the operation of the individual switches (up/down switches) 31 for driving the ink fountain blades 4, so that the adjustment is done in a shorter time.

Second Embodiment

Figure 10:
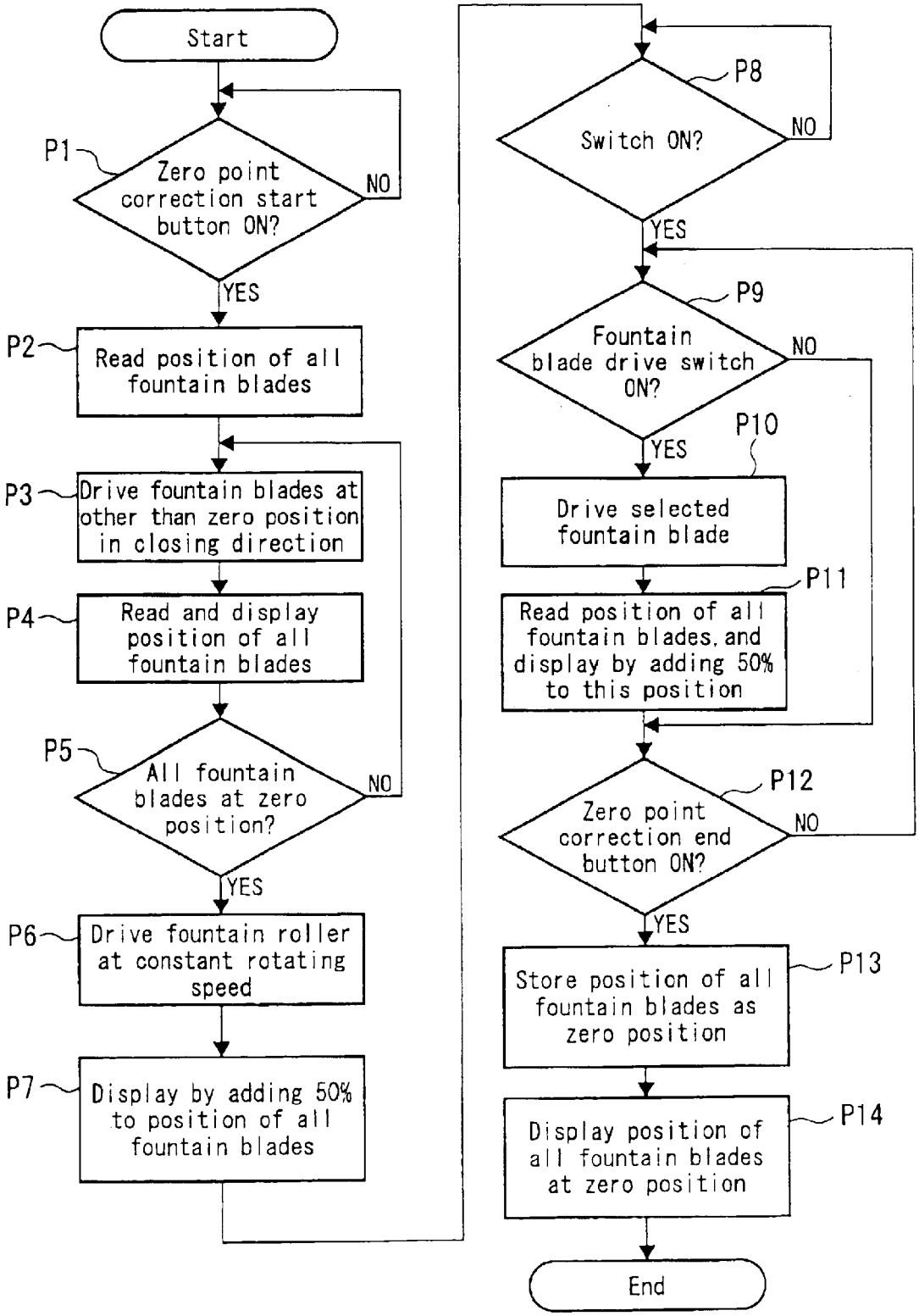
FIG. 10 is a flowchart of zero point correction showing a second embodiment of the invention.

FIG. 10 is a flowchart of a zero point correction method showing a second embodiment of the invention.

In this example, whether the zero point correction start button 33 is turned on or not is judged first at step P1, instead of step P6 (for judging if the zero set button 32 has been turned on or not in the first embodiment). Thereafter, the procedure following step P2 is same as in the first embodiment.

According to this embodiment, the control operation is simplified.

However, the invention is not limited to these embodiments, but may be changed and modified within the scope and spirit of the invention. For example, the zero set button (switch) 32, the zero point correction start button (switch) 33, the zero point correction end button (switch) 34, the all-increase button (switch) 35, and the all-decrease button (switch) 36 which are provided in part of the operation and display unit 25B on the operation stand 27, may be provided on the operation and display unit 25A on the front side of the ink fountain main body 4A of each ink fountain device. Also, at step P8 in FIG. 9 or step P7 in FIG. 10, 50% is added to the position of all ink fountain blades 4 and so indicated on the display; however, this value of 50% may be stored in the memory, and the indication may be changed to the stored 50%, and during the subsequent home position adjustment, the value adjusted from 50% may be indicated as either increasing or decreasing.

According to the invention which, comprises a first step of positioning each ink fountain blade at its home position, a second step of setting the indication of the position of each ink fountain blade at a predetermined value, a third step of adjusting the position of each ink fountain blade while observing the indication of the position of each ink fountain blade, and a fourth step of storing the position of each ink fountain blade adjusted at the third step as a new home position, the position of each ink fountain blade can be handled numerically when adjusting the home position, and the operation is clear and easy to understand.

According to the invention, which comprises a first step of positioning each ink fountain blade at home position, a second step of adjusting the position of all ink fountain blades by the same amount by a switch operation, and a third step of storing the position of each ink fountain blade as was adjusted at the second step as a new home position, the operation is easy, and the required adjustment time is shorter.

According to the invention, which comprises a drive device for adjusting the position of each ink fountain blade, and a control device for controlling the drive device, positioning each ink fountain blade at its home position, setting its indication at a predetermined value, and storing the adjusted position of each ink fountain blade as a new home position while observing the indication, the position of each ink fountain blade can be handled numerically when adjusting the home position, and the operation is clear and easy to understand.

According to the invention, which comprises a drive device for adjusting the position of each ink fountain blade, and a control device for controlling the drive device, positioning each ink fountain blade at its home position, adjusting the position of all ink fountain blades by the same amount by a switch operation, and storing the adjusted position of each ink fountain blade as a new home position, the operation is easy and the required adjustment time is shorter.

What is claimed is:

1. A method for adjusting the home position of an ink fountain blade of a printing press having a plurality of ink fountain blades, wherein the ink feed amount to be supplied from an ink fountain into an ink fountain roller is adjusted by adjusting the position of these ink fountain blades, supplying ink to a printing plate through the ink fountain roller, and printing the ink supplied on the printing plate on a printing sheet, the method comprising:

positioning each ink fountain blade at its home position;

setting an indication of the position of each ink fountain blade at a value that is obtained by adding a predetermined value to zero;

adjusting the position of each ink fountain blade while observing the indication of the position of each ink fountain blade to a value which is obtained by adding the predetermined value;

storing the position of each ink fountain blade as so adjusted as a new home position for that ink fountain blade; and setting an indication of the position of each ink fountain blade as a zero position.

2. The method for adjusting the ink fountain blade home position of a printing press according to claim 1, wherein said printing press has a drive device for adjusting the position of each ink fountain blade, and a control device for controlling said drive device, and, at the adjusting step, the position of each ink fountain blade is adjusted by operation of a switch provided in the control device.

3. The method for adjusting the ink fountain blade home position of a printing press according to claim 1, wherein the adjustment of the position of all ink fountain blades by the same amount occurs by a switch operation.

4. An apparatus for adjusting a home position of an ink fountain blade of a printing press having a plurality of ink fountain blades, the ink feed amount to be supplied from an ink fountain into an ink fountain roller is adjusted by adjusting the position of the ink fountain blades, supplying ink to a printing plate through the ink fountain roller, and printing the ink supplied on the printing plate on a printing sheet, comprising:

a drive device for adjusting the position of each ink fountain blade; and a control device that positions each ink fountain blade at its home position, sets an indication of the position of each ink fountain blade at a value obtained by adding a predetermined value to zero, controls said drive device such that the position of each ink fountain blade is adjusted while observing the indication of the position of each ink fountain blade to a value obtained by adding the predetermined value, stores the adjusted position of each ink fountain blade as a new home position for that ink fountain blade, and sets an indication of the position of each ink fountain blade as a zero position.

5. The apparatus for adjusting the ink fountain blade home position of a printing press according to claim 4, further comprising:

an indicator for displaying the indicia of the position of each ink fountain.

6. The apparatus for adjusting the ink fountain blade home position of a printing press according to claim 4, wherein said drive device includes, a stepping motor assembled in an ink fountain main body to correspond to each ink fountain blade, and a screw shaft connected to an output shaft of the stepping motor through a gear train, having a first threaded portion coupled to a fixing member fixed on the ink fountain main body and a second threaded portion coupled to each ink fountain blade, such that rotation of the screw shaft by said stepping motor causes movement of the screw shaft itself, and differential movement of the ink fountain blade coupled to the second threaded portion of said screw shaft causes movement of the ink fountain blade in directions in to contact with and to depart from contact with the ink fountain roller.

7. The apparatus for adjusting the ink fountain blade home position of a printing press according to claim 6, further comprising:

a pressure spring held by a support shaft projecting from said ink fountain main body and a support shaft attached to the ink fountain blade, such that the ink fountain blade is always pressed in a direction away from the ink fountain roller by this pressure spring, so that any excessive play in each screw coupling portion is reduced.

8. The apparatus for adjusting the ink fountain blade home position of a printing press according to claim 4, wherein the control device adjusts the position of all ink fountain blades by the same amount by a switch operation.

9. The apparatus for adjusting the ink fountain blade home position of a printing press according to claim 8, wherein and said switch is provided near the plurality of ink fountain blades.

10. The apparatus for adjusting the ink fountain blade home position of a printing press according to claim 8, wherein said drive device includes a stepping motor assembled in an ink fountain main body to correspond to each ink fountain blade, and a screw shaft connected to an output shaft of the stepping motor through a gear train, having a first threaded portion coupled to a fixing member fixed on the ink fountain main body and a second threaded portion coupled to each ink fountain blade, such that rotation of the screw shaft by said stepping motor causes movement of the screw shaft itself, and differential movement of the ink fountain blade coupled to the second threaded portion of said screw shaft causes movement of the ink fountain blade in directions in to contact with and to depart from contact with the ink fountain roller.

11. The apparatus for adjusting the ink fountain blade home position of a printing press according to claim 10, further comprising:

a pressure spring held by a support shaft projecting from said ink fountain main body and a support shaft attached to the ink fountain blade, such that the ink fountain blade is always pressed in a direction away from the ink fountain roller by this pressure spring, so that any excessive play in each screw coupling portion is reduced.

* * * * *